US006247273B1

(12) United States Patent
Nickel

(10) Patent No.: US 6,247,273 B1
(45) Date of Patent: Jun. 19, 2001

(54) ADJUSTABLE FORM BRACE

(75) Inventor: Shane L. Nickel, Fargo, ND (US)

(73) Assignee: Reechcraft, Inc., Fargo, ND (US)

( * ) Notice: Subject to any disclaimer, the term of this patent is extended or adjusted under 35 U.S.C. 154(b) by 0 days.

(21) Appl. No.: 09/249,870

(22) Filed: Feb. 16, 1999

(51) Int. Cl.[7] ..... E04G 21/18; E04G 21/22

(52) U.S. Cl. ..... 52/127.2; 52/146; 52/149; 52/152; 182/82; 182/230; 248/235; 248/240.2; 248/250

(58) Field of Search ..... 52/127.2, 146, 52/149, 36.4, 150, 151, 152; 248/235, 240.2, 250; 182/82, 230

(56) References Cited

U.S. PATENT DOCUMENTS

| | | | | |
|---|---|---|---|---|
| 73,346 | * | 1/1868 | Lambs et al. | 182/82 |
| 132,583 | * | 10/1872 | Jester | 182/82 |
| D. 243,853 | * | 3/1977 | Ejchorszt | 52/146 |
| 977,862 | * | 12/1910 | Grant | 52/127 |
| 1,347,453 | * | 7/1920 | Garner | 182/82 |
| 3,213,965 | * | 10/1965 | Fedoryk | 182/82 |
| 3,425,510 | * | 2/1969 | Fedoryk | 182/82 |
| 3,574,981 | * | 4/1971 | Henschen | 52/127 |
| 3,817,006 | * | 6/1974 | Williams | 52/149 |
| 4,068,427 | * | 1/1978 | Camardo | 52/127 |
| 5,388,663 | * | 2/1995 | Phillippe et al. | 182/82 |
| 6,065,254 | * | 5/2000 | Lanka | 52/127.2 |

* cited by examiner

*Primary Examiner*—Carl D. Friedman
*Assistant Examiner*—Dennis L. Dorsey
(74) *Attorney, Agent, or Firm*—Merchant & Gould PC

(57) ABSTRACT

An adjustable bracing system is configured for supporting poured concrete wall systems and includes a vertical brace for engaging the wall. A slider slides vertically along a channel of the vertical brace. An adjustable length leg member connects at an upper end to the slider and extends outward away from the brace and connects at a lower end to a foot member. The leg is rotatably mounted at one end to a threaded member, wherein rotation of the leg in a first direction extends the threaded member and the length of the leg member, and rotation in a second opposite direction retracts the threaded member and shortens the length of the leg member. When needed, scaffolding framework mounts along a first edge to the slider.

20 Claims, 1 Drawing Sheet

ADJUSTABLE FORM BRACE

FIELD OF THE INVENTION

The present invention is directed to an adjustable bracing system and method, and in particular to an adjustable bracing system and method for supporting styrofoam concrete wall systems during pouring and setting of the walls.

BACKGROUND OF THE INVENTION

Systems for forming basement walls of concrete with styrofoam support systems are well known and have recently become a popular choice for forming walls. Other systems such as concrete block are labor intensive and do not provide desired insulation characteristics that are possible with a styrofoam form system. Such a system typically uses styrofoam forms which interlock to form a wall system. The forms receive poured concrete within the sides of the form. When the system is complete, the walls include Styrofoam forms on either side of the concrete, acting as insulation so that a strong, inexpensive and well insulated wall is created that requires relatively little labor.

One problem with such a system is that until the concrete is set, the styrofoam forms have relatively little support. Therefore, the concrete must generally be poured around the entire form a few feet at a time rather than pouring the entire height of the wall during one pouring period. As the concrete sets, it gains strength and stability so that additional concrete may be poured to build up the wall. Should the styrofoam forms fail, the results can be disastrous. In addition, once the walls are set, it is difficult, if not impossible in many circumstances, to later correct the plumb of the wall without causing structural damage. Therefore, it is important to support the styrofoam forms so that they do not fail and so that they are aligned in a proper vertically extending plane while being poured.

Current methods of support include extending props inward from an upward portion of the wall to support the form. The forms are generally dug into the ground or wedged on the concrete slab of the basement. However, the form may shift slightly so that adjustment may be necessary. Props may be difficult to move and adjust as the power and strength required to make an adjustment and move the prop is substantial. In addition, if the prop is moved while supporting the wall, adjustment may leave the wall momentarily unsupported, so that the chances of failure increase.

In addition to supporting the wall, the props prevent easy placement of scaffold and that allow workers to access upper portions of the wall as may be necessary for ensuring proper pouring of the cement to the upper portions or performing other construction work. As the supports must be placed at intervals generally 6 to 10 feet, it is difficult or impractical to erect scaffolding along the walls for workers.

It can be seen then that new improved support system is needed for poured concrete systems with interlocking Styrofoam forms. Such a system should provide for supporting the styrofoam blocks in a manner that prevents failure and provides for adjustment while maintaining constant support of the wall. Such a system should also provide adjustment that provides continuous support and a mechanical advantage during adjustment so that a worker can easily correct the position of the vertical support to ensure that the wall is plumb. Such a system should also provide for supporting planks for workers to access upper regions of the walls. The present invention addresses these as well as other problems associated with wall support systems.

SUMMARY OF THE INVENTION

The present invention is directed to an adjustable wall brace system and a method for using the wall brace system.

Poured concrete walls are used with Styrofoam form systems which have interlocking sections and provide support during pouring and insulation when the concrete is set. The walls often require support to prevent collapsing and to align the wall while the concrete sets. In addition, other types of walls and work also commonly require an adjustable brace system.

The present invention includes a vertical wall engaging portion that forms a C-type channel facing away from the wall. The base connects at a lower end and may be wedged to the wall to ensure contact. The vertical channel member includes an angled leg member extending at a diagonal downward and engages the ground away from the wall to provide bracing. The leg member connects at an upper end to a pivot on a slider. The slider moves vertically along the channel formed in the wall engaging portion. The leg member is connected at the upper end to the pivot threading connector so that rotation of the leg member extends and retracts the threaded connector. The lower end of the leg member mounts on a swivel to a foot that is configured for staking to the ground or concrete slab. In this configuration, the leg member may be rotated to extend or retract the connector and thereby change the length of the angled support leg. By changing the length of the angled support leg, the position of the wall engaging portion may be adjusted so that the wall position may be maintained until it is plumb. The slider also supports a walkway or scaffolding assembly including a framework and a framework support. The framework extends outward and away from the slider to support planking, such as two by ten inch boards. Planking may be extended over the framework between two of the bracing devices for scaffolding workers to walk on. The framework may also include a removable guard extending above the planks that can support a safety railing or rope for added safety.

The bracing system provides adjustment as the slider may be moved between multiple positions engaging stops spaced along the channel formed in the wall engaging portion. In addition, the foot is pivotally mounted on a swivel of the lower end of the leg member to fit against the contour of the ground. With this configuration, the wall brace system may be adapted fit within the available space and provide support where it is needed.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding elements throughout the several views.

DETAILED DESCRIPTION

Figure 1:
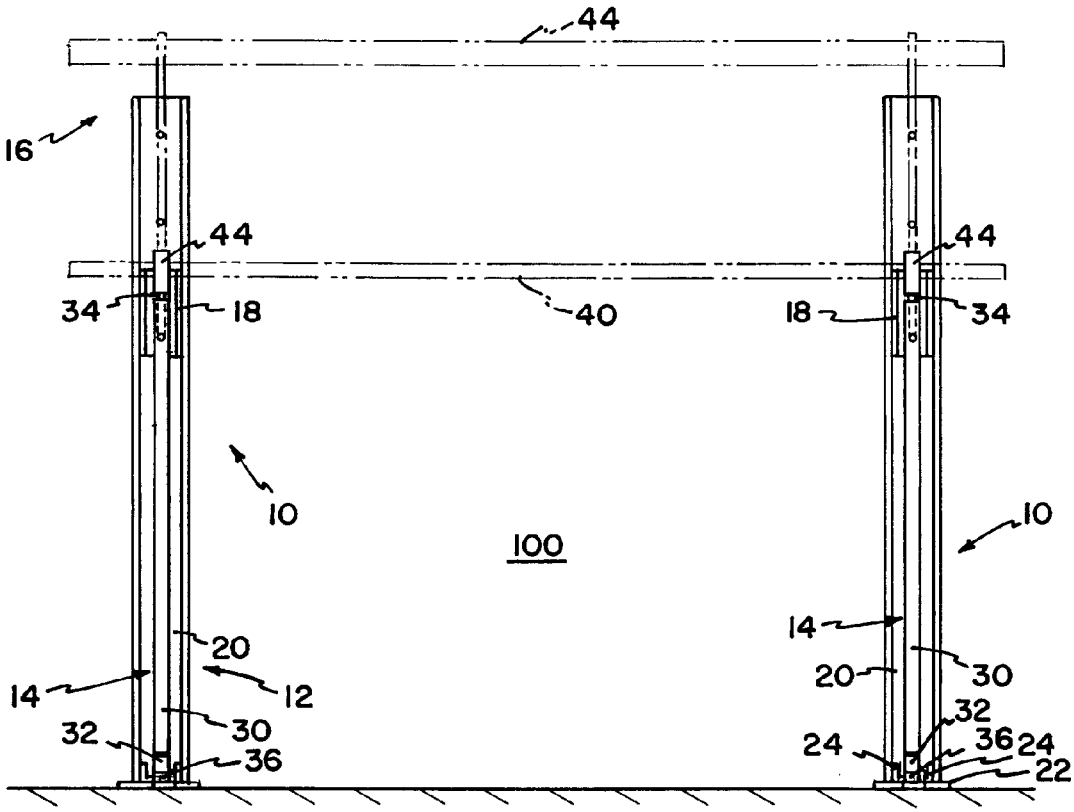
FIG. 1 shows a front elevational view of an adjustable bracing system according to the principles of the present invention.
Figure 2:
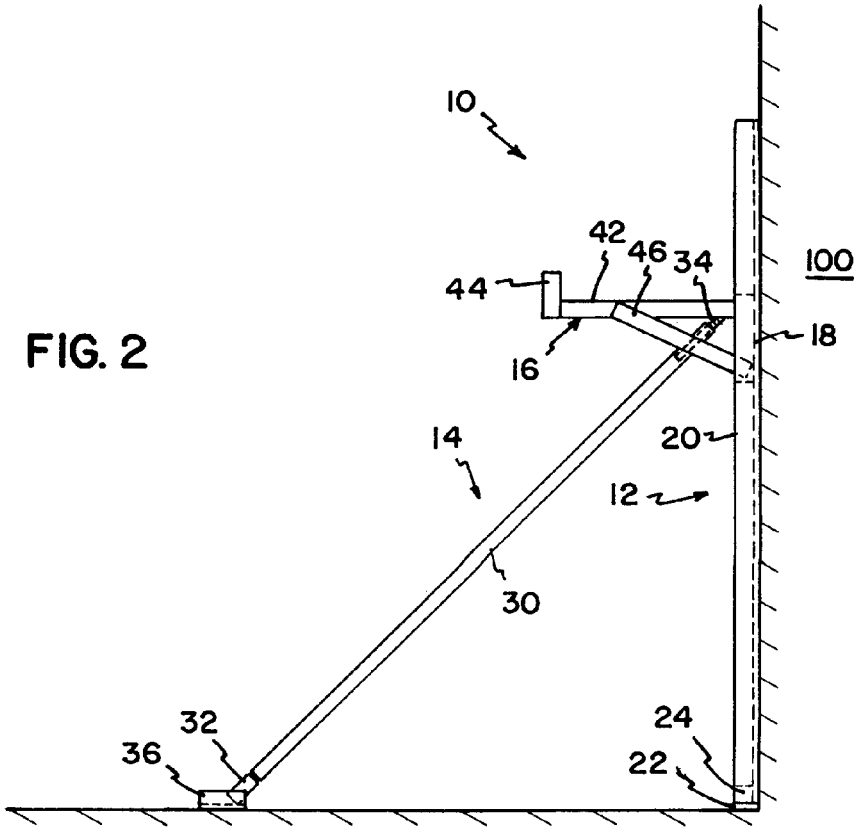
FIG. 2 shows a side sectional view of the adjustable bracing system taken along line 22 of FIG. 1.

Referring now to the drawings, and in particular to FIG. 1, there is shown an adjustable wall brace system, generally designated 10. The wall brace system 10 is set against a wall, generally designated 100. The wall may be any type of wall or vertical surface but may, for example, be a poured concrete and Styrofoam form system, as also shown in FIG. 2. The adjustable brace apparatus 10 includes a wall engaging portion 12, preferably including a C-type channel member 20. A slider 18 mounts in the channel of the wall engaging portion 12, and may be a channel member nesting and sliding within the channel member 20. An angled support leg 14 extending diagonally from slider 18. A walkway or scaffolding assembly 16 is also supported above the angled support leg 14 on the slider 18.

The channel member 20 may include bolts, pins or other stop members to hold the slider 18 at spaced apart vertical positions along the channel corresponding to mounting holes spaced along the channel member 20. The channel member 20 slides onto a base 22 having tabs 24 extending upward into the lower end of the channel 20. The tabs 24 bolt or pin to the channel member 20 in a preferred embodiment. During installation, the base 22 may be wedged under the wall 100 or otherwise nailed to the wall so that proper contact and support are maintained.

The angled support 14 includes a leg member 30 mounted to a threaded connector 34 on the slider 18 at an upper end. At the lower end, the leg member 30 extends down to a swivel 32 on a foot 36. The foot 36 may be wedged against the ground, often a concrete slab, or may be permanently bolted or staked into place during pouring. The leg member 30 is preferably configured to have a non-circular periphery so that it may be easily grasped. As the leg member 30 connects to a threaded connector, rotation of the leg member retracts and extends the threaded connector 34 relative to the upper end of the leg member. This rotation increases or decreases the overall length of the angled support 14, depending on the direction of the rotation. By changing the length of the angled support 14, the position of the wall engaging portion 12 may also be adjusted. It can be appreciated that this adjustment may occur without interruption of the support provided by the brace apparatus 10. The swiveling adjustment also provides a mechanical advantage for actuating adjustments to the brace apparatus so that easy adjustments may be made by workers without requiring great strength or special tools. The pitch of the threaded connector 34 also provides for very precise adjustments as a full turn of the leg member 30 results in movement of only a small fraction of an inch. Therefore, the wall engaging portion 12 may be plumbed to ensure that it is extending vertically.

The slider 18 also supports the scaffolding assembly 16. The vertical channel members are typically eight feet high to provide support along a large portion of the wall 100. After the lower section of the wall 100 has been poured, workers may still need access to perform additional work on the upper portion of the wall 100 to perform other tasks, such as ensuring proper pouring of concrete into the upper portion. The scaffolding assembly 16 provides support for the workers when necessary. The scaffolding assembly 16 includes a framework 42 projecting outward from the wall engaging portion 12. The framework supports the planking 40 extending vertically between two or more braces 10. A support 46 angles from the lower portion of the slider 18 to an outer position on the framework 42 to provide additional support to the framework 42. A guard system 44 mounts to the outer end of the framework 42 and may be retained with a pin or other connector to allow easy attachment and removal. The guard 44 typically extends upward and may include rope, chains or rails extending between the upright portions.

The slider 18 may be positioned at one or more stops along the length of the vertical channel member 20. The stops are typically interfaced at intervals such as 4, 6 and 8 feet. In this configuration, the scaffolding assembly 16 may be placed at the desired height. The angled support leg 14 includes a pivotal mount at both ends so that the leg may be positioned to adopt to any of the positions of the slider 18 and to engage the ground at a required distance away from the wall engaging portion 12.

To use the bracing system 10, the base 22 is placed in a desired position against the base of the wall 100 and nailed or otherwise secured. The channel member 20 is slid onto the base 22 and pinned or bolted to the base and nailed to the wall 100. The slider 18 is set at the desired height and pinned or bolted to the channel member 20. The foot 36 is placed and attached to the ground at the approximate desired location so that the wall engaging portion 12 is substantially vertical. The wall position is checked and the support leg 14 retracted or extended until the wall 100 is supported at the desired position. The planks 40 may be placed on the supporting framework 42 if scaffolding 16 is needed. The supports are left in position until the concrete is cured and the entire system 10 is removed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An adjustable bracing system comprising:

a substantially vertical brace including an inner channel member sliding within an outer channel;

an adjustable length leg member connected at an upper end to the inner channel member and extending outward away from the brace; and scaffolding framework extending substantially horizontally, and mounted along a first edge to the brace.

2. An adjustable bracing system according to claim 1, further comprising framework supports mounted at a first end to the inner channel member and at a second end to the framework.

3. An adjustable bracing system according to claim 1, wherein the vertical brace includes a base plate adapted for attaching under a base of a wall.

4. An adjustable bracing system according to claim 1, wherein the vertical brace includes a slider member adapted for sliding vertically along the vertical brace.

5. An adjustable bracing system according to claim 1, further comprising a foot member mounted at a lower end of the leg member.

6. An adjustable bracing system comprising:

a substantially vertical brace;

an adjustable length leg member connected at an upper end to the brace and extending outward away from the brace; and scaffolding framework extending substantially horizontally, and mounted along a first edge to the brace a removably mounted guard extending along and upward from the scaffolding framework.

7. An adjustable bracing system according to claim 6, further comprising a foot member mounted at a lower end of the leg member.

8. An adjustable bracing system comprising:

a substantially vertical brace;

an adjustable length leg member connected at an upper end to the brace and extending outward away from the brace; and scaffolding framework extending substantially horizontally, and mounted along a first edge to the brace;

wherein the leg is rotatably mounted at one end to a threaded member, and wherein rotation of the leg in a first direction extends the threaded member and the length of the leg member, and rotation in a second opposite direction retracts the threaded member and shortens the length of the leg member.

9. An adjustable bracing system according to claim 8, wherein a second end of the leg member is rotatably mounted to a foot member.

10. An adjustable bracing system comprising:

a substantially vertical brace including a slider member adapted for sliding vertically along the vertical brace;

an adjustable length leg member connected at an upper end to the brace and extending outward away from the brace; and scaffolding framework extending substantially horizontally, and mounted along a first edge to the brace;

wherein the scaffolding framework and the adjustable length leg member mount to the slider member.

11. An adjustable bracing system according to claim 10, further comprising a foot member mounted at a lower end of the leg member.

12. A method of supporting a wall system, the method comprising the steps of:

supplying a brace system having a vertical brace having a channel member and a base, and a slider and a diagonally extending adjustable length support member pivotally mounted to the slider at a first end and to a foot at a second end;

securing the base to the wall system;

sliding the channel member onto the base and securing the channel member to the wall system;

adjusting the slider to a desired height and attaching to the channel member;

securing the foot to the ground;

adjusting the length of the adjustable length support member, so that the wall system extends at a predetermined position.

13. A method according to claim 12, wherein the length of the support member is adjusted while the brace system maintains contact with the wall system.

14. A method according to claim 12, wherein the support member is rotated to adjust its length.

15. An adjustable bracing system comprising:

a substantially vertical brace;

a slider adapted for sliding vertically along the vertical brace;

an adjustable length leg member connected at an upper end to the slider and extending outward away from the brace; and a foot member mounted at a lower end of the leg member.

16. An adjustable bracing system according to claim 15, further comprising scaffolding framework extending substantially horizontally, and mounted along a first edge to the slider.

17. An adjustable bracing system according to claim 15, wherein the leg is rotatably mounted at one end to a threaded member, and wherein rotation of the leg in a first direction extends the threaded member and the length of the leg member, and rotation in a second opposite direction retracts the threaded member and shortens the length of the leg member.

18. An adjustable bracing system according to claim 17, wherein the threaded member mounts to the slider.

19. An adjustable bracing system comprising:

a substantially vertical brace;

a slider adapted for sliding vertically along the vertical brace;

an adjustable length leg member connected at an upper end to the slider and extending outward away from the brace.

20. A method of supporting a wall system, the method comprising the steps of:

supplying a brace system having a vertical brace having a channel member and a base, and a slider and a diagonally extending adjustable length support member pivotally mounted to the slider at an upper end;

securing the base to the wall system;

sliding the channel member onto the base and securing the channel member to the wall system;

adjusting the slider to a desired height and attaching to the channel member;

setting the support member against the ground;

adjusting the length of the adjustable length support member, so that the wall system extends at a predetermined position.

* * * * *